US006675443B2

(12) United States Patent
Vitz

(10) Patent No.: US 6,675,443 B2
(45) Date of Patent: Jan. 13, 2004

(54) FIBER MATERIAL REMOVAL DEVICE

(75) Inventor: Michael Vitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/349,101

(22) Filed: Jan. 23, 2003

(65) Prior Publication Data

US 2003/0159252 A1 Aug. 28, 2003

(30) Foreign Application Priority Data

Feb. 28, 2002 (DE) ..... 102 08 969

(51) Int. Cl.[7] ..... D01B 3/00
(52) U.S. Cl. ..... 19/200; 19/107; 19/203
(58) Field of Search ..... 19/65 A, 65 R, 19/98, 105, 106 R, 107, 108, 109, 200, 202, 203, 204, 205; 209/146, 149

(56) References Cited

U.S. PATENT DOCUMENTS 5,084,942 A * 2/1992 Schelb et al. ..... 19/200

FOREIGN PATENT DOCUMENTS

| | | |
|---|---|---|
| DE | 81 06 844 U1 | 1/1985 |
| DE | 87 12 681 U1 | 2/1989 |
| DE | 87 13 684 U1 | 3/1989 |
| DE | 39 01 313 A1 | 7/1990 |
| DE | 39 40 594 A1 | 6/1991 |
| DE | 196 45 844 A1 | 5/1998 |
| DE | 199 25 506 A1 | 12/2000 |
| GB | 2 375 355 A | 11/2002 |

* cited by examiner

*Primary Examiner*—Gary L. Welch
(74) *Attorney, Agent, or Firm*—Venable LLP; Robert Kinberg; Stuart I. Smith

(57) ABSTRACT

A device for use with a fiber processing machine is provided. The device has a rotating cylinder, a fiber material feeding device that feeds fibers to the cylinder, an air duct that extends essentially tangential to the cylinder in a fiber-removal zone, an airflow creating device coupled to the air duct and creating an airflow in the air duct, and at least two adjustable airflow adjustment elements arranged inside the air duct in the fiber-removal zone.

20 Claims, 6 Drawing Sheets

FIBER MATERIAL REMOVAL DEVICE

CROSS-REFERENCE TO RELATED APPLICATION

This application claims priority to German Patent Application No. 102 0 969.8, filed Feb. 28, 2002, the disclosure of which is incorporated herein by reference.

BACKGROUND OF THE INVENTION

The invention relates to a device on a cleaning machine, an opening machine, a carding machine or the like for fiber material such as cotton, synthetic fibers or the like. The machine has a fiber-material removal device, a fiber-material feeding device, a cylinder rotating at a high speed, an air duct extending essentially tangential in the fiber-material removal zone and a suctioning device that is connected to the air duct, wherein the wall region opposite the air duct can guide the air flow and the air-flow guidance can be changed.

With a known device of this type shown in German Patent document 39 01 313 A1, the air duct wall positioned opposite a main carding cylinder is an air-guide plate. The air-guide plate is continuously curved and the surface facing the main carding cylinder is closed continuously. The air-guide plate can be adjusted as a whole, such that the gap width, a throttling point between the inside wall of the air-guide plate and the circumference of the cylinder, can be varied. One disadvantage is that the direction and/or strength of the airflow can only be changed as a whole.

SUMMARY OF THE INVENTION

It is an object of the invention to create a device of the aforementioned type, which avoids the previously mentioned disadvantages and, in particular, easily permits a differentiated change in the airflow.

This object is solved with a device for use with a fiber processing machine, the device including: a rotating cylinder; a fiber material feeding device that feeds fibers to the cylinder; an air duct that extends essentially tangential to the cylinder in a fiber-removal zone; an airflow creating device coupled to the air duct and creating an airflow in the air duct; and at least two adjustable airflow adjustment elements provided inside the air duct in the fiber-removal zone.

A differentiated change in the airflow can be achieved with the aid of several airflow adjustment elements in the air duct. In particular, the direction and/or the strength of the airflow can be purposely varied. The air flowing uniformly into the fiber removal zone is thus influenced so as to result in a plurality of individual airflow sections. The air adjustment elements are thus arranged such that they can be changed and permit an optimized fiber removal from the cylinder. One particular advantage is that the number of neps in the fiber floccules removed from the cylinder is reduced considerably.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
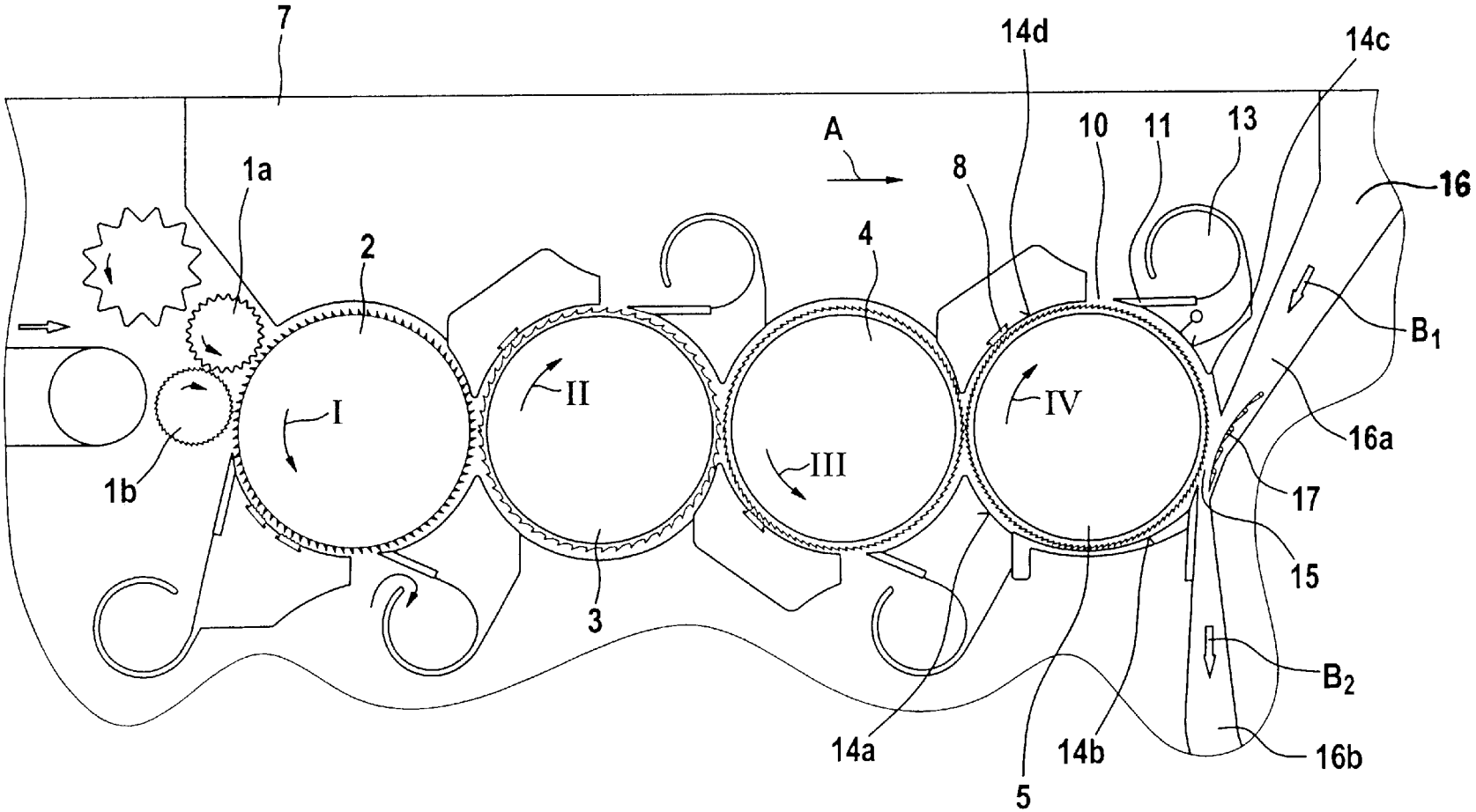
FIG. 1 is a schematic side elevation view of a four-cylinder cleaner with a device according to the invention.

FIG. 1 shows a cleaning device arranged inside a closed housing 7, for example a model CVT 4 manufactured by the company Trützschler in Mönchengladbach, Germany, supplied with a fiber material to be cleaned, in particular cotton in the floccule form. The material is supplied, for example, via a filling chute (not shown herein), with the aid of a conveyor belt, or a similar device. The batting is supplied by two feed cylinders 1*a*, 1*b* and a pin-type cylinder 2, which is positioned inside the housing 7 and rotates in counter-clockwise (arrow I) direction. The pin cylinder 2 is followed by sequentially arranged additional saw-tooth cylinders 3, 4 and 5, rotating in the directions II, III, IV. A clothed cylinder 3 that is covered with saw-tooth clothing follows the pin cylinder 2. The pin cylinder 2 has, for example, a circumferential speed of approximately 10 to 21 m/s while the clothed cylinder 3 has a circumferential speed of approximately 15 to 25 m/s. The cylinder 4 has a higher circumferential speed than the clothed cylinder 3. The cylinders 2 to 5 have a diameter of approximately 150 to 300 mm, and the housing encloses cylinders 2 to 5.

A fixed carding element 8, an air flow-through opening 10, and a separating knife 11 are assigned to the saw-tooth cylinder 5. A suctioning hood 13 is assigned to the separating knife 11. The operating direction of the cleaner is indicated by arrow A.

The cylinder 5 is enclosed by a cover which is composed of a plurality of curved cover elements 14*a* to 14*d*. Foreign particles and the like are discharged through the first opening 10, existing between the cover elements 14*d* and 14*c*. A second opening 15 exists between the cover elements 14*c* and 14*b*, through which the fiber material is removed with a flow of air from the cylinder 5. The fiber material is fed from the cylinder 4 to the cylinder 5 through a third opening between the cover elements 14*a* and 14*d*. A pneumatic fiber removal device is assigned to the cylinder 5, which consists of a duct 16 with the opening 15 in its wall region (so-called air doffers). The duct 16 has an air intake line 16*a* for suctioning in an airflow $B_1$, as well as an air extraction line 16*b*, through which a fiber-air mixture $B_2$ is suctioned off. In FIG. 1, the total airflow essentially flows from the top to the bottom. The air extraction line 16*b* is connected to a suction source (not shown herein).

In the fiber removal zone 15, several air adjustment elements 17, designed as guide vanes, are installed inside the air duct 16. These air adjustment elements 17 can be used to adjust the airflow strength of flows $B_1$, $B_2$ for removing the fiber material from the cylinder 5 at the second opening 15. The strength of the flows of air $B_1$, $B_2$ depends on the air volume, the air speed and/or the air pressure.

Figure 2:
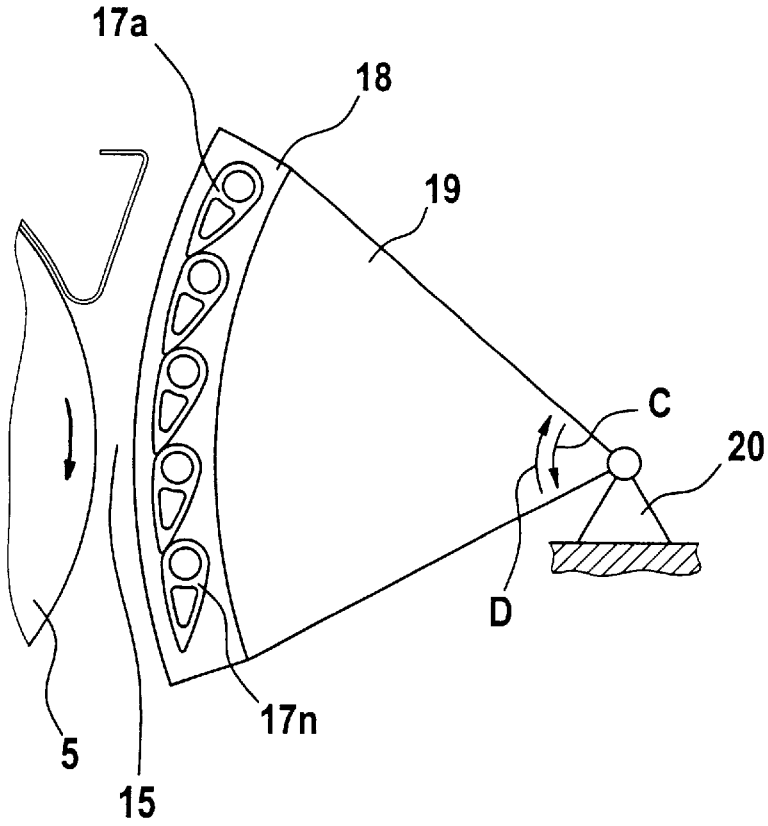
FIG. 2 is a schematic side elevation view of a support with airflow adjustment elements, the support being rotatable around a fulcrum.

FIG. 2 shows a plurality of guide vanes 17*a* to 17*n* (five guide vanes are shown in FIG. 2), which are attached to a joint holder 18. The holder is attached via a holding element 19 to a pivoting bearing 20, such that it can pivot in the direction of arrows C, D. The location (position) of the guide vanes 17*a* to 17*n* inside the duct 16 is changed through a rotation in the direction C, D. The position of the guide vanes 17*a* to 17*n* relative to the cylinder 5 can also be changed in this way.

Figure 3:
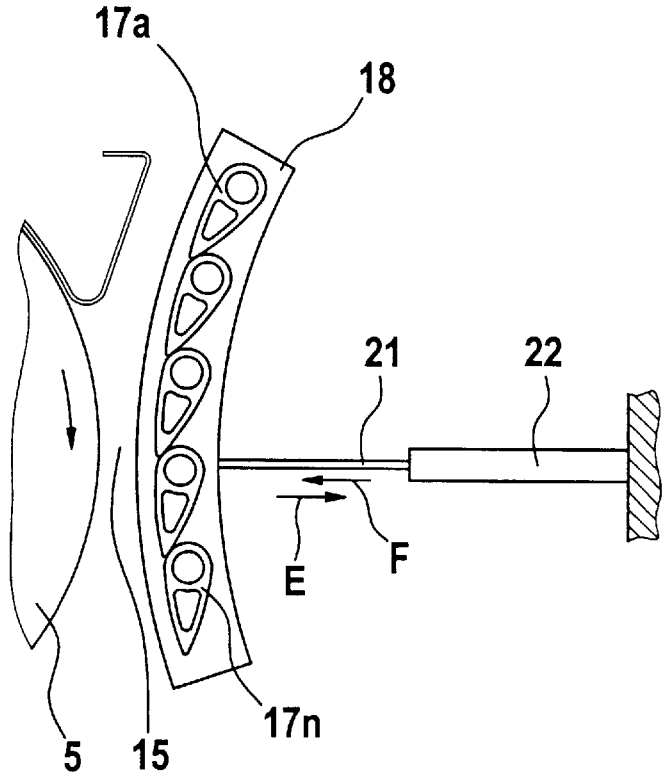
FIG. 3 is a schematic side elevation view of the support with airflow adjustment elements, the support being displaceable linearly in the direction of the cylinder.

According to FIG. 3, the holder 18 is attached via a holding element 21 to a locally fixed bearing element 22. The holding element 21 can be moved linearly in the direction of arrows E, F. Thus, the guide vanes 17*a* to 17*n* can also be moved in the direction E, F. The position of the guide vanes 17*a* to 17*n* inside the duct 16 and the distance to the cylinder 5 are changed in this way.

Figure 4A:
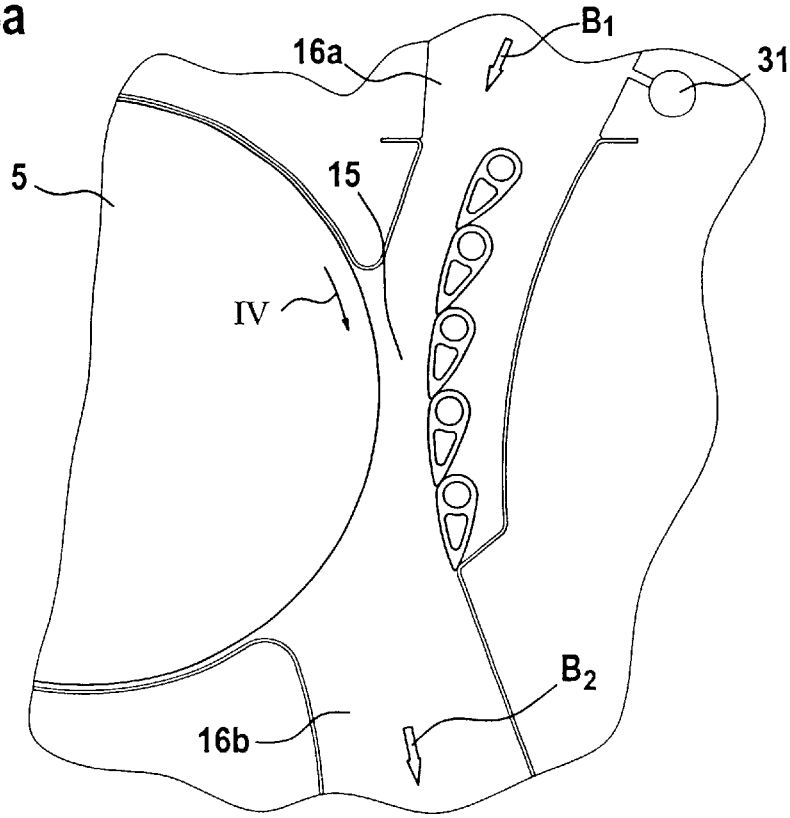
FIG. 4*a* shows the airflow adjustment elements in a closed position.

FIG. 4*a* shows the guide vanes 17*a* to 17*n* in the closed position. The curved outer surfaces of each guide vane 17*a* to 17*n*, which face the cylinder 5 and are disposed one behind the other, form a closed, curved wall surface along which the airflow $B_1$ flows. Aided by the centrifugal force generated by cylinder 5, the airflow $B_1$ flowing out of the duct section 16*a* removes the fiber floccules from the cylinder 5 in the fiber removal zone 15. The airflow $B_2$, loaded with fiber floccules, flows into the duct section 16*b* and is then suctioned off from there. As shown in FIG. 4*c*, the individual guide vanes 17, which are designed aerodynamically to resemble an airplane wing, are attached in the inflow region with a pivoting bearing 23 such that they can pivot in the direction of arrows G, H. The pivoting occurs with the aid of a driving device (not shown herein), for example a drive motor.

Figure 4B:
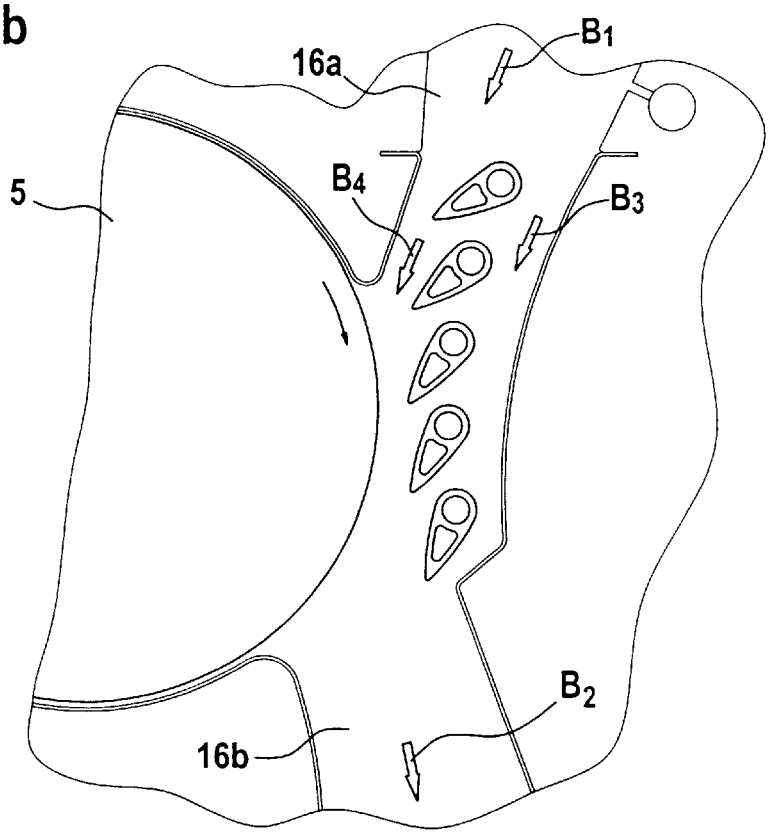
FIG. 4*b* shows the airflow adjustment elements in an opened position.
Figure 4C:
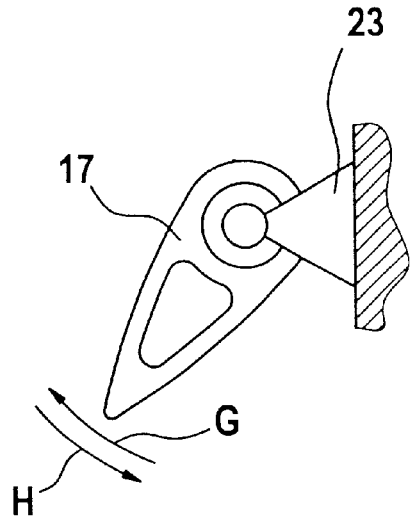
FIG. 4*c* shows an airflow adjustment element attached to a pivoting bearing such that it can rotate.
Figure 4D:
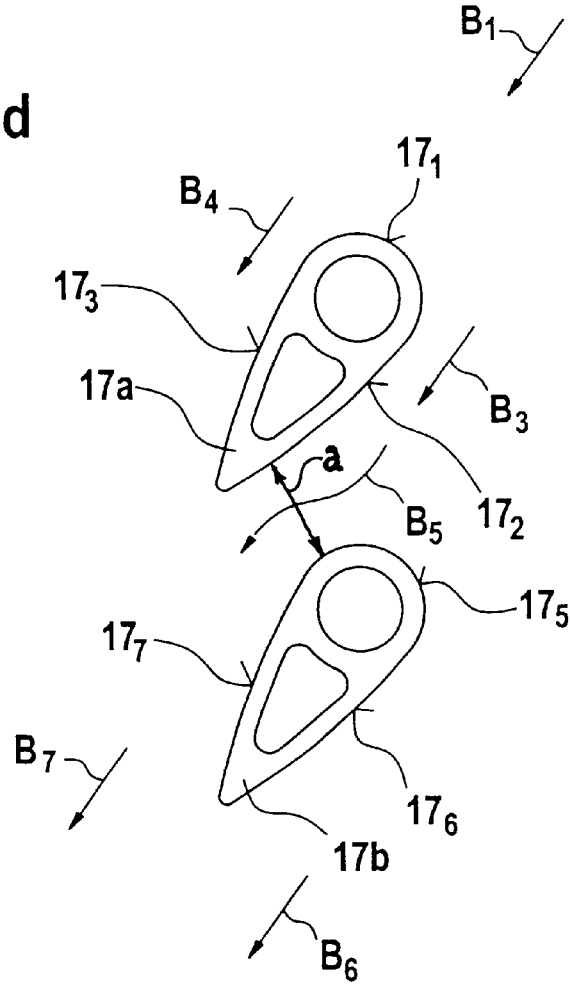
FIG. 4*d* shows flows of air in the region of two airflow adjustment elements.

FIG. 4*b* shows the guide vanes 17*a* to 17*n* in an opened position. A continuously open gap exists between adjacent guide vanes 17*a* to 17*n*, through which an airflow can flow. FIG. 4*d* shows the flows of air in the region between two adjacent opened guide vanes 17*a*, 17*b*. The airflow $B_1$ is divided at the curved inflow end $\mathbf{17}_1$ of guide vane 17*a* into two flows of air $B_3$ and $B_4$. The airflow $B_3$ in this case flows along flank $\mathbf{17}_2$ that faces away from the cylinder 5 and the airflow $B_4$ flows along the flank $\mathbf{17}_3$ of guide vane 17*a* that faces the cylinder 5. At the curved inflow end $\mathbf{17}_5$ of the guide vane 17*b*, the airflow $B_3$ is divided into two flows of air $B_5$ and $B_6$. The airflow $B_5$ flows through the gap between the guide vanes 17*a* and 17*b* and the airflow $B_6$ flows along the flank $\mathbf{17}_6$ of guide vane 17*b* that faces away from the cylinder. The airflow $B_5$ combines with the airflow $B_4$ and continues to flow as airflow $B_7$ along the flank $\mathbf{17}_7$ of guide element 17*b* that is facing the cylinder. As a result of the guide vanes 17*a* to 17*n* pivoting in the direction G, H (FIG. 4*c*), the width a (FIG. 4*d*) of the flow-through opening between adjacent guide vanes 17*a* to 17*n* is changed and adjusted. This results in a differentiated change in the flows of air, particularly with respect to the flow direction, flow speed and flow pressure and thus an adjustable change in the removal of the fiber floccules from the saw-tooth clothing or the pin clothing of cylinder 5 (air doffing). The airflow B can be a flow of blast air, a suction airflow or a combination flow of blast air and suction air. Blast and/or suction airflow sources are connected to the duct 16 (not shown herein).

Figure 5:
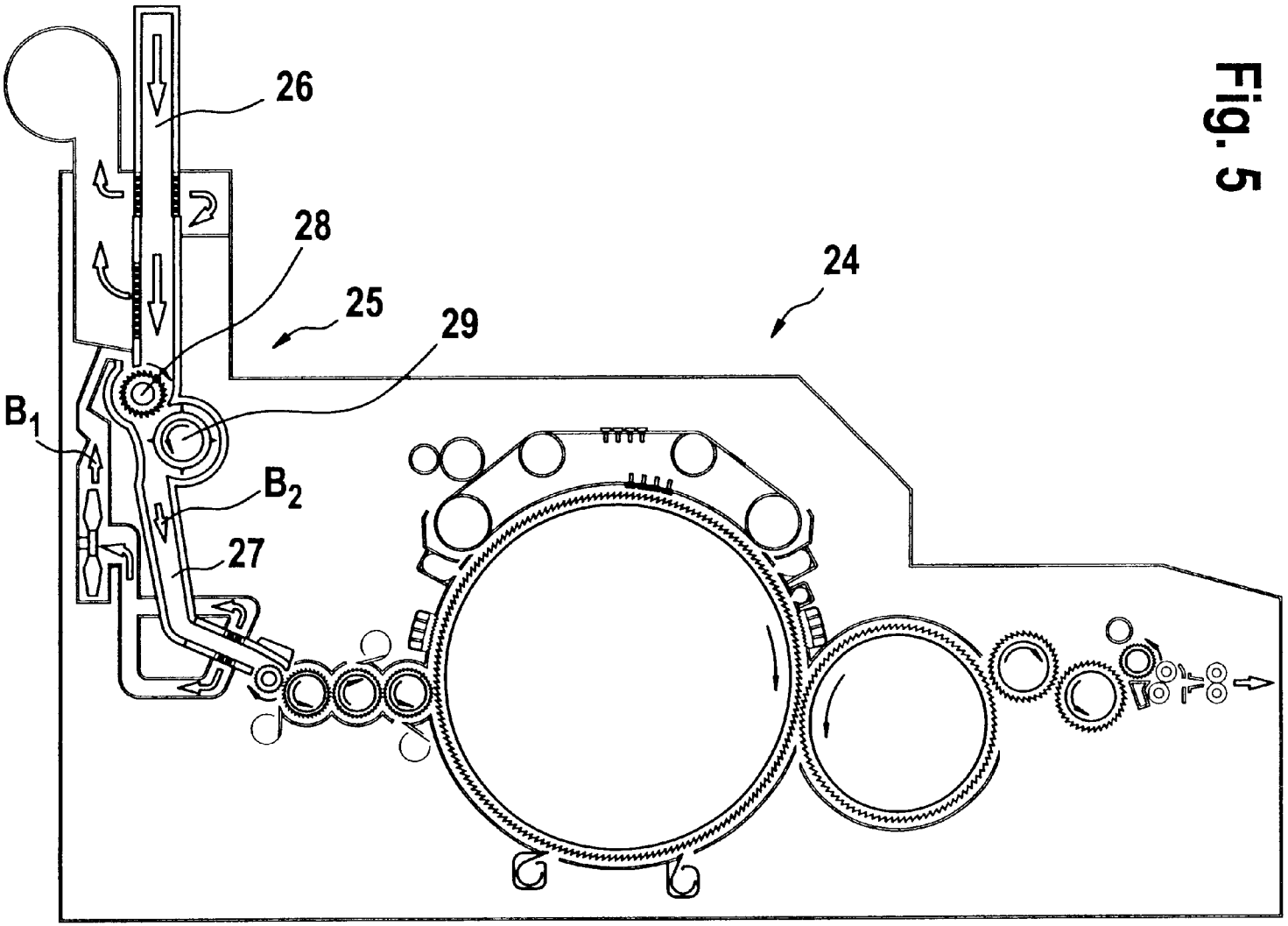
FIG. 5 is a schematic side elevation view of a carding machine having an upstream-connected floccule-feeding device and a device according to the invention.
Figure 6:
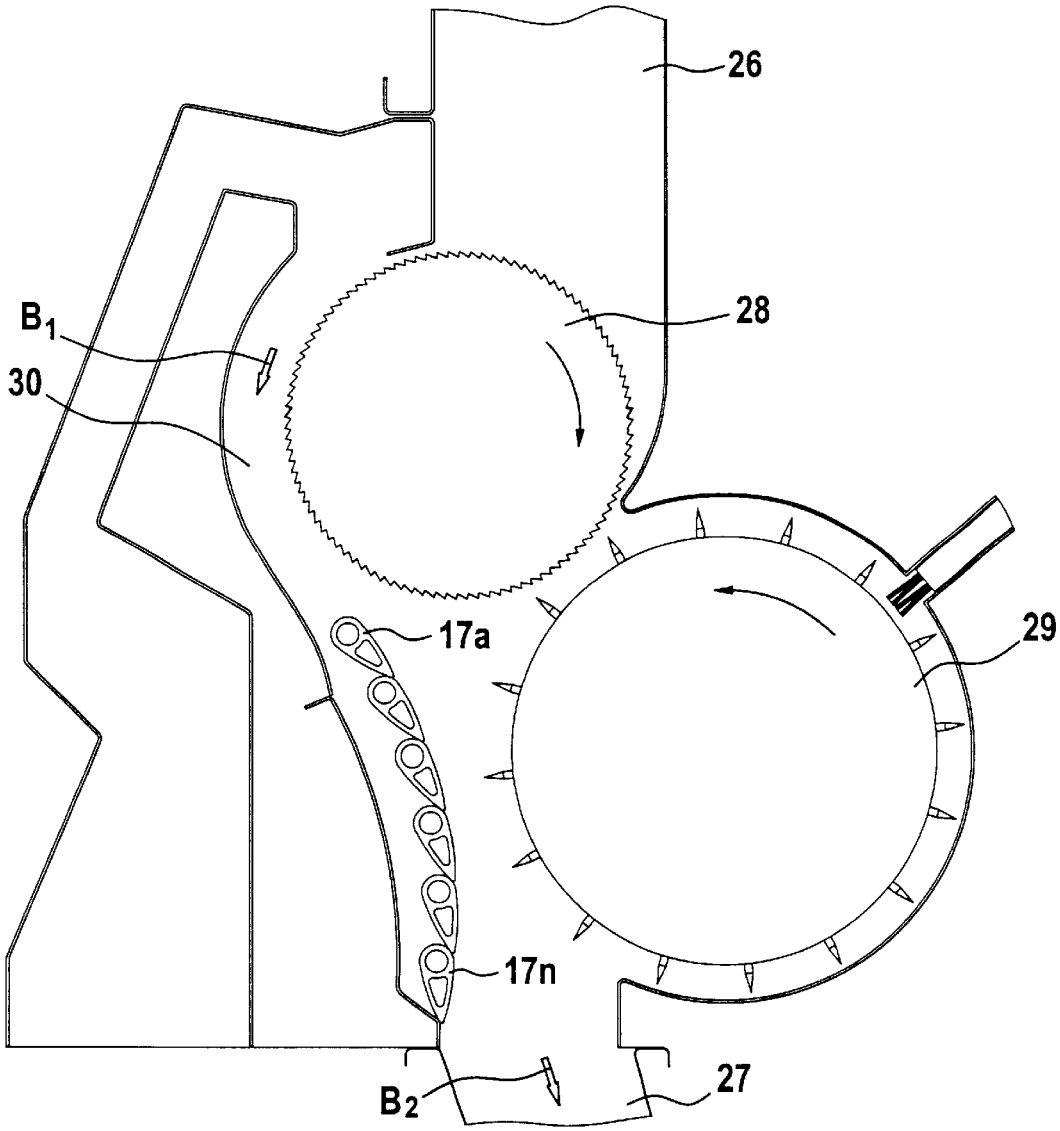
FIG. 6 shows a plurality of airflow adjustment elements in the region of a floccule breakup unit.

FIGS. 5 and 6 show that a floccule feeder, such as a TR ÜTZSCHLER Directfeed DFK, is installed upstream of a carding machine 24, for example a TRÜTZSCHLER high-performance carding machine model DK 903. The floccule feeder 25 is provided with an upper reserve chute 26 and a lower feeding chute 27, between which a floccule loosening device is disposed. The floccule loosening device has a slow-moving intake cylinder 28 and a fast-moving opening cylinder 29. A curved air feed duct 30 is provided along the intake cylinder 28, through which the airflow $B_1$ flows in the direction of the opening cylinder 29. A plurality of guide vanes 17*a* to 17*n* (FIG. 6 shows six guide vanes 17) are disposed inside the air feed duct 30, essentially arranged opposite the opening cylinder 29. With respect to design and function, the guide vanes 17*a* to 17*n* correspond to the guide vanes 17*a* to 17*n* shown in FIGS. 4*a* to 4*d*. By changing the position of the guide vanes 17*a* to 17*n*, shown in the closed position in FIG. 6, to the position shown in FIG. 4*b*, for example, the airflow $B_1$ is changed in the manner as explained in FIG. 4*d*. Thus, a desired type of pneumatic removal of the fiber floccules from the opening cylinder 29 is realized. An airflow $B_2$ that is saturated with removed fiber floccules thus enters the feed chute 27.

According to FIG. 4*a*, an air pressure measuring element 31 that is connected to an electronic control and regulating device (not shown herein) can be connected to the air duct 16. The control and regulating device is connected to the drive motor (not shown herein) for pivoting the guide vanes 17 in the direction G, H, as shown in FIG. 4*c*.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A device for use with a fiber processing machine, the device comprising:

a rotating cylinder;

a fiber material feeding device that feeds fibers to the cylinder;

an air duct extending essentially tangential to the cylinder in a fiber-removal zone;

means coupled to the air duct for creating an airflow in the air duct; and at least two adjustable airflow adjustment elements arranged inside the air duct in the fiber-removal zone.

2. The device according to claim 1, wherein the airflow adjustment elements are arranged one behind the other in a direction of the airflow.

3. The device according to claim 1, wherein the airflow adjustment elements are adjustable guide vanes.

4. The device according to claim 3, wherein each guide vane has a pivoting bearing at one end.

5. The device according to claim 4, wherein another end of each guide vane points in a direction of the airflow.

6. The device according to claim 4, wherein another end of each guide vane points in a rotational direction of the cylinder.

7. The device according to claim 3, wherein each guide vane has a curved surface facing the cylinder.

8. The device according to claim 3, wherein the guide vanes form a closed wall surface when in a closed position.

9. The device according to claim 3, wherein air flow-through openings are formed between the guide vanes when the guide vanes are in an opened position.

10. The device according to claim 1, wherein a gap width between the cylinder and surfaces of the airflow adjustment elements that are facing the cylinder is adjustable.

11. The device according to claim 3, further comprising a joint holder on which the guide vanes are arranged.

12. The device according to claim 11, further comprising a pivoting bearing on which the joint holder is mounted.

13. The device according to claim 11, further comprising a linear adjustment device on which the joint holder is mounted.

14. The device according to claim 1, wherein the air duct directs the airflow such that fibers are retrieved from the cylinder.

15. The device according to claim 1, further comprising a suction duct operatively associated with the fiber removal zone.

16. The device according to claim 11, further comprising a pressure measuring element connected to the guide vanes via a control device.

17. The device according to claim 16, further comprising a control device that receives data from the pressure measuring element and is operatively associated with the joint holder of the guide vanes.

18. The device according to claim 1, wherein the airflow adjustment elements influence a pressure of the airflow inside the air duct.

19. The device according to claim 1, wherein the airflow is oriented approximately tangential to the cylinder.

20. The device according to claim 1, wherein the intensity of the airflow at the cylinder is adjustable.

* * * * *